United States Patent [19]

Moritoki et al.

[11] Patent Number: 4,467,185

[45] Date of Patent: Aug. 21, 1984

[54] HEATER FOR HOT ISOSTATIC PRESSING APPARATUS

[75] Inventors: Masato Moritoki, Miki; Takao Fujikawa; Junichi Miyanaga, both of Kobe, all of Japan

[73] Assignee: Kabushiki Kaisha Kobe Seiko Sho, Kobe, Japan

[21] Appl. No.: 437,023

[22] Filed: Oct. 27, 1982

[30] Foreign Application Priority Data

Oct. 28, 1981 [JP] Japan ..... 56-161806[U]

[51] Int. Cl.[3] ..... H05B 3/02

[52] U.S. Cl. ..... 219/539; 219/390; 219/406; 373/130; 373/134; 432/205

[58] Field of Search ..... 219/85 R, 390, 406, 219/408, 424, 431, 425, 440, 537, 539; 373/111, 112, 113, 130, 12, 134, 137; 432/205; 338/294

[56] References Cited

U.S. PATENT DOCUMENTS

| | | | |
|---|---|---|---|
| 3,150,226 | 9/1964 | Thorne et al. | 373/130 |
| 3,395,241 | 7/1968 | Roman | 219/390 X |
| 3,632,954 | 1/1972 | Smith, Jr. | 373/119 X |
| 4,249,032 | 2/1981 | Smith, Jr. et al. | 219/406 X |
| 4,268,708 | 5/1981 | Smith, Jr. et al. | 219/390 X |
| 4,280,807 | 7/1981 | Smith, Jr. et al. | 432/205 |

*Primary Examiner*—Volodymyr Y. Mayewsky
*Attorney, Agent, or Firm*—Oblon, Fisher, Spivak, McClelland & Maier

[57] ABSTRACT

A heater which includes: at least two electrically conductive heating element units having generally a self-standing cylindrical shape and stacked one on another to define a series of at least two cylindrical heating zones, the heating element units each including of a grid-like structure alternately having a vertically disposed portion and a horizontally extending bridge portion; insulator blocks fitted on the ends of stacked upper and lower cylindrical heating element units which meet and which are made of a material having a sufficient electric resistance that will not conduct electric current at a maximum operating temperature of the heating element units; and an annular shaped connector conforming with the ends of the upper and lower heating element units which meet and which is interposed between the insulating blocks on the ends which meet to provide a mechanical connection between the stacked upper and lower heating element units.

7 Claims, 6 Drawing Figures

HEATER FOR HOT ISOSTATIC PRESSING APPARATUS

BACKGROUND OF THE INVENTION

1. Field of the Invention

This invention relates to a heater construction for use as a heat source of a hot isostatic pressing apparatus, and more particularly to a heater having a plurality of heater units mechanically connected with each other by a connecting means which has excellent electric insulating properties under high temperature and pressure conditions along with sufficient resistance to thermal impacts, ensuring stable heating operation by the heater over a long time period.

2. Description of the Prior Art

The hot isostatic pressing apparatus which heats and compresses a workpiece or workpieces in a high temperature and pressure gas atmosphere mostly employs a heater of the construction shown in FIG. 1(*a*) to (*c*), with heating elements of special material like graphite to ensure endurance under severe operating conditions of the hot isostatic pressing (hereinafter referred to simply as "HIP" for brevity) at a temperature higher than 1250° C. and a pressure of from several hundreds to several thousands atms.

The heating element of such non-metallic material has a high compression strength but, if formed with a reduced thickness in order to increase the value of resistance, it is easily flexed and readily damaged even by a slight mechanical shock due to its fragility. Therefore, it becomes necessary to take utmost care in handling and in fixation in a HIP furnace of high temperature and pressure.

The conventional heater of this sort has the so-called segment type heating element 3*b* of U- or W-shape 3*c* as shown in FIG. 1(*b*) or of rod shape as shown in FIG. 1(*c*). The segments of these shapes are relatively easy to manufacture but usually necessitate the troublesome work of connecting the individual segments within a furnace. In contrast, the unitary heating element 3*a* shown in FIG. 1(*a*) is easier to assemble into a furnace. In any event, the respective heating elements 3*a*, 3*b* and 3*c* have merits and demerits, and, as far as the accuracy of assembling into the furnace is concerned, the segment type is difficult to build with an accurate cylindrical shape as compared with the unitary type. This is reflected by the fact that the unitary type is more favorably accepted in most cases.

In order to cope with the recent trend toward HIP systems of larger scales, the heater elements 3' have come to be used in a stacked form as shown particularly in FIG. 2, stacking more than two heating element units 3' one on another to form a heater 2'. This is because more difficulties are involved in the manufacturing process of the unitary type heaters of larger sizes, and it is necessary to divide the heater 2' into a plurality of heating zones of different capacities for eliminating temperature variations between the upper and lower localities within the furnace. The heater structure with multiple stories can be obtained simply by fixing and connecting the stacked heating element units 3' usually with the use of annular insulators 5'.

However, the heaters 2' as required by the large HIP apparatus have problems in that there is a possibility of damaging either the insulator 5' or the heating element units 3' whichever is lower in strength by the large thermal stress due to the differences in thermal expansion, and in that selection of insulators 5' which have good electric insulating property at high temperatures as well as satisfactory resistance to thermal shocks will invite a disadvantage in production costs, and technical difficulties in the manufacturing process.

SUMMARY OF THE INVENTION

With the foregoing situations in view, the present invention contemplates the elimination of the above-mentioned drawbacks or problems of the conventional heaters. More particularly, it is an object of the present invention to provide a multi-storied heater construction for hot isostatic pressing apparatus, which has sufficient resistance to thermal shocks and at the same time can be assembled in a facilitated manner, without sacrificing an economical advantage.

According to the invention, the above-mentioned object is achieved by a heater construction which comprises: at least two heating element units having generally a self-standing cylindrical shape and stacked one on another to define a series of at least two cylindrical heating zones, the heating element units each consisting of a grid-like structure alternately having a vertically disposed portion and a horizontally extending bridge portion; insulator blocks fitted on ends which meet of stacked upper and lower cylindrical heating element units and made of a material having sufficient electric resistance at a maximum operating temperature of the heating element units; and a connector of an annular shape conforming with the meeting ends of the upper and lower heating element units and interposed between the insulating blocks on the meeting ends to provide a mechanical connection between the stacked upper and lower heating element units.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1A:
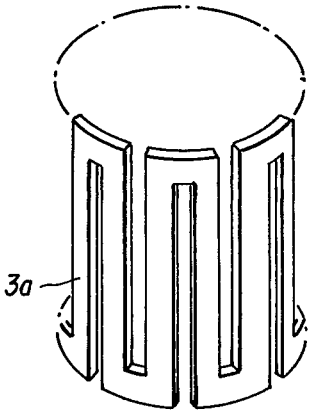
FIG. 1a PRIOR ART
FIGS. 1(*a*) to 1(*c*) are schematic perspective views of conventional heating elements of heaters for a hot isostatic pressing apparatus.
Figure 1B:
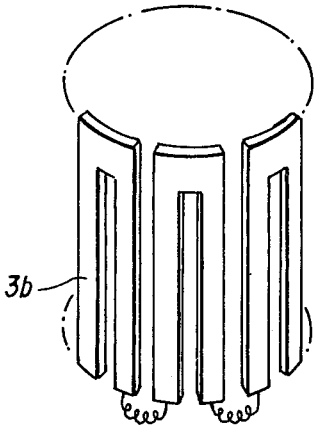
FIG. 1b PRIOR ART
Figure 1C:
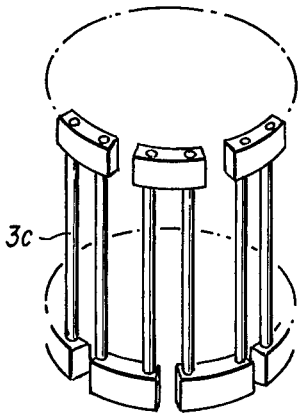
FIG. 1c PRIOR ART
Figure 2:
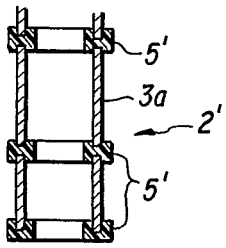
FIG. 2 PRIOR ART
FIG. 2 is a schematic section of a conventional stacked heater construction.
Figure 4:
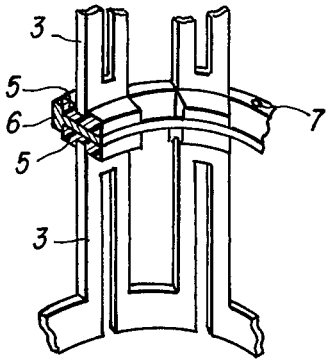
FIG. 4 is a fragmentary perspective view of a modified heater construction according to the invention.
Figure 3:
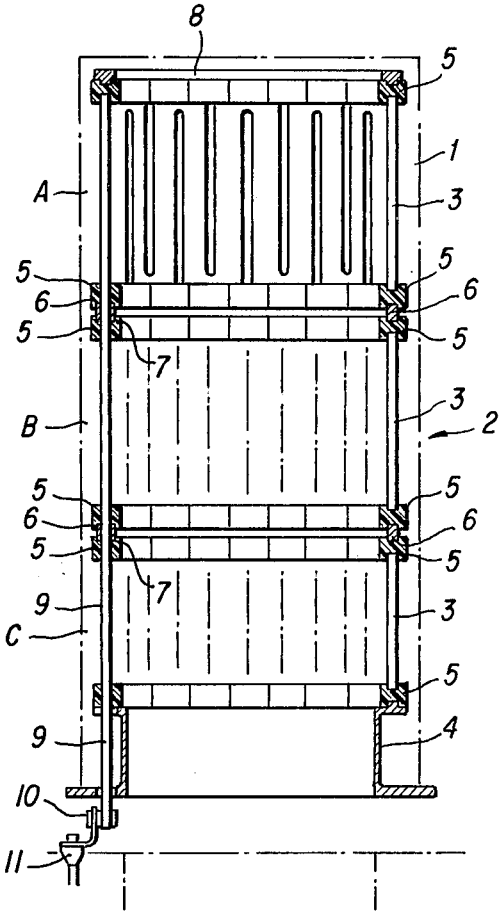
FIG. 3 is a sectional front elevational view of a heater construction embodying the present invention.

Hereafter, the invention is described more particularly by way of preferred embodiments shown in FIGS. 3 and 4.

Referring to FIG. 3, indicated by double-dot chain line is a furnace chamber 1 of a hot isostatic pressing apparatus, which is enclosed by a heat insulating wall to create a high temperature and high pressure gas atmosphere therein.

The furnace chamber 1 is provided with a heater 2 according to the present invention, the heater 2 being in the form of an ordinary cylinder or a polygonal cylinder and disposed concentrically in a cylindrical space of the furnace chamber 1 to heat a workpiece or workpieces (not shown) uniformly from peripheral portions of the chamber.

The heater 2 consists of a stack of at least two heating element units 3, three units in the particular example being shown, each having a self-standing cylindrical grid-like structure of a non-metallic material like graphite consisting alternately of a vertically disposed portion and a horizontally extending bridge portion connecting two adjacent vertically disposed portions either at their upper or lower ends, the heater 2 forming continuously at least two coaxial heating zones (three heating zones A to C in the particular example shown). The heater 2 thus constitutes a self-standing cylindrical structure as a whole and is supported on a seat 4 of a metallic material.

The heating element unit 3 is made of a non-metallic material, and may be of an oxide type heater.

The heating element units 3 which define the heating zones A to C, respectively, have the respective upper and lower ends held in an electrically insulated state in a number of insulator blocks or segments 5, mechanically connecting the meeting ends of the upper and lower units 3 by a connector 6 of a heat resistant material which is interposed between the insulator blocks 5 to thereby form a heater 2 consisting of heating element units 3 which are integrally stacked one on another and electrically insulated from each other.

The insulator blocks 5 are formed of a material which has a sufficient dielectric strength such that the blocks 5 will not conduct electric current at the maximum operating temperature of the heating element unit 3, and each have a length corresponding to the horizontally extending bridge portions at the upper and lower ends of the heating element unit 3. The insulators 5 are H-shaped in section and have grooves on the upper and lower sides for receiving the horizontally extending bridge portions of the heating element unit 3 and the annular flange of the connector 6.

By fitting the insulator blocks 5 on the respective horizontal bridge portions of the heating element unit 3, they are arranged in the form of a ring as a whole. If desired, of course, each insulator block 5 may be formed in such shape and length which engages two or more horizontal bridge portions of the heating element unit 3. The insulator blocks 5 which are smaller in size are easier to fabricate as compared with the conventional insulators of a unitary annular structure.

The material for the insulator blocks 5 is selected depending upon the maximum operating temperature, for example, from sintered $Al_2O_3$, $Si_3N_4$, BN or other oxides or nitrides or mixtures thereof.

On the other hand, the connector 6 of heat resistant material is formed into an annular or notched annular shape consisting of a unitary body or a number of joined segments and conforming with the shapes of the upper and lower ends of the heating element unit 3. In the particular example shown in FIG. 3, the connector 6 is provided with annular protuberances on the upper and lower sides thereof for fitting engagement with the annular grooves in the insulator blocks 5.

The connector 6 can be formed into a predetermined shape from a material selected from various heat resistant materials, but it is preferred to be made of the same material as the heater element 3, for example, to be made of graphite in a case where the heater units 3 are of graphite. As will be easily understood, the choice of the same material prevents the production of the thermal stress due to the difference in thermal expansion between the two component parts. The connector 6 is easier to mold to shape as compared with the insulator blocks 5, so that it causes almost no problem in the fabrication process even if it consists of a unitary body of a relatively large size.

The upper end of a lower heater element unit 3 is mechanically connected to the lower end of an upper heater element unit 3 by the connector 6 through the insulators 5 through fitting engagement of the annular protuberances of the connector 6 with the annular grooves in the opposing end faces of the insulators 5. In this manner, a suitable number of the heating element units 3 are stacked one on another to form a multistoried heater in which the weights of upper heating element units are supported by the lower heating element units. In the event there should occur deviations in relative positions of the heating element units 3 due to deflections or for other reasons, the connector 6 can absorb such deviations and stably hold the heating element units.

The term "mechanical connection" as used in this specification should be construed as having a broad meaning including not only a strongly connected state but also a buffered connection which permits slight positional deviations of two coupled component parts.

The connector 6 is not limited to the shape as illustrated particularly in FIG. 3, and may be formed into a T-shape in section as shown in FIG. 4 in a fragmentary perspective view, with flanges around the outer periphery of a flat annular portion which is gripped between the opposing flat faces of the insulator blocks 5. In this case, the connector 6 receives vertical forces and horizontal forces due to thermal expansion by the flat annular portion and the outer flange portions, respectively, achieving the required mechanical connection to a sufficient degree.

Further, the annular flat portion of the connector 6 may be provided with a hole 7 at a suitable position, which can be conveniently used to pass through an electric conducting rod for supplying heating power to the upper heating elements, without increasing the width or the radial dimensions of the heater to provide a compact heater construction.

Indicated at 8 of FIG. 3 is a ring which is similar to the connector 6 in shape and made of the same material, the ring 8 being fitted on and connecting the insulator blocks 5 at the upper end of the heating element unit which constitutes the uppermost heating zone.

If desired, the combination of the ring 8 and the insulator blocks 5 may be omitted, exposing the upper end of the uppermost heating element unit without any insulating means or treatment. In FIG. 3, reference numerals 9, 10 and 11 denote a conductor to the heating element units 3 in zones A, B and C so that electric current will flow in the heating element units, an electrode, and a terminal provided on a bottom lid of the high pressure vessel, respectively.

With the above-described heater construction according to the present invention, the mechanical connection between upper and lower heating element units is provided by a connector which is gripped between the insulator blocks, in contrast to the conventional heater construction in which the mechanical connection between the heating element units is constituted by the insulator itself. The most practical advantage which accrues from the heater construction of the invention is that the insulator 5 can be produced in segments or in the form of small blocks by the use of dies of small sizes to reduce the production cost.

The insulator blocks 5 of each heating zone engage the end portion of one heating element unit 3 alone, so that it is extremely easy to design them in such a manner as to prevent serious damage to either the heating element unit 3 or the insulator blocks 5 by the thermal stress caused by the difference in thermal expansion between them, coupled with the advantages of the segmented structure of the insulator 5 in practical and designing aspects.

Further, the connector 6 which is employed in the present invention has a function of connecting the adjoining heating element units 3 with a buffering effect, so that the insulator 5 is used solely for the function of electric insulation, relying on the connector 6 for the function of absorbing or buffering the thermal shocks. Therefore, it becomes possible to simplify the manufacturing process and to provide a heater construction which exhibits excellent properties in both electric insulation and resistance to thermal shocks in a high temperature and pressure condition. Thus, the heater construction according to the present invention has a great practical value for use in hot isostatic pressing apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heater for use in a hot isostatic pressing apparatus which isostatically compresses a heated workpiece in a high temperature and high pressure gas atmosphere, said heater comprising:

at least two electrically conductive heating element units having generally a self-standing cylindrical shape and stacked one on another to define a series of at least two cylindrical heating zones, wherein said heating element units each further comprise a grid-like structure alternately having a vertically disposed portion and a horizontally extending bridge portion;

a plurality of insulator blocks fitted on ends of said upper and lower cylindrical electrically conductive heating element units which meet and which comprise a material having a sufficient predetermined electric resistance that will not conduct electric current at a maximum operating temperature of said electrically conductive heating element units;

an annular shaped connector conforming with said ends which meet of said upper and lower electrically conductive heating element units and which is interposed between said insulator blocks on said ends which meet so as to form a mechanical connection between said upper and lower electrically conductive heating element units; and a conductor operatively associated with said electrically conductive heating element units for supplying heating power thereto.

2. A heater as set forth in claim 1, wherein said insulator blocks are fitted on said horizontal bridge portions at said ends which meet of said upper and lower electrically conductive heating element units.

3. A heater as set forth in claims 1 or 2, wherein said insulator blocks have grooves formed therein and said connector has annular protuberances formed therein on upper and lower sides thereof for fitting engagement with said grooves formed on said insulator blocks.

4. A heater as set forth in claim 1, wherein said connector further comprises a connector T-shaped in section and which further comprises a flat annular body gripped between said insulator blocks of said upper and lower electrically conductive heating element units, said flat annular body having flanges formed around an outer peripheral portion of said flat annular body for holding said insulator blocks from outside.

5. A heater as set forth in claim 4, further comprising a conductor operatively associated with said upper electrically conductive heating element units for supplying heating power thereto wherein said connector has a hole formed therein in a predetermined position to pass through said conductor.

6. A heater as set forth in claim 1, wherein said electrically conductive heating element unit and connector each further comprise the same non-metallic material.

7. A heater as set forth in claim 1, wherein said electrically conductive heating element units and connector each comprise graphite.

* * * * *